US005234399A

United States Patent [19]

Boughton et al.

[11] Patent Number: 5,234,399

[45] Date of Patent: Aug. 10, 1993

[54] BUCKLE CHUTE JAM ACCESS MEANS

[75] Inventors: Richard D. Boughton, Bethel; Jeffrey T. Mulreed, Branford; Joan T. Wagner, Fairfield; Walter Wolog, Orange, all of Conn.

[73] Assignee: Pitney Bowes Inc., Stamford, Conn.

[21] Appl. No.: 809,569

[22] Filed: Dec. 17, 1991

[51] Int. Cl.[5] ..... B65H 45/14

[52] U.S. Cl. ..... 493/420; 493/421

[58] Field of Search ..... 493/419-421, 493/476; 270/45

[56] References Cited

U.S. PATENT DOCUMENTS 4,518,380 5/1985 Shimizu ..... 493/420

5,000,432 3/1991 Krasuski ..... 493/420

*Primary Examiner*—Bruce M. Kisliuk

*Assistant Examiner*—Jack Lavinder

*Attorney, Agent, or Firm*—Charles R. Malandra, Jr.; Melvin J. Scolnick

[57] ABSTRACT

A folding machine buckle chute with means for accessing paper jams is provided. The access means, comprising two pivotable sidewalls secured by a doubleslotted latch, allows for simple and rapid removal of jammed sheets from the buckle chute without disassembly.

11 Claims, 4 Drawing Sheets

BUCKLE CHUTE JAM ACCESS MEANS

BACKGROUND OF THE INVENTION

This invention relates to paper folding machines, particularly to buckle chutes in those machines.

Buckle chutes for paper folding machines are well known. In operation, a sheet of paper is fed by a set of rollers into a chute until the leading edge of the sheet comes into contact with a paper stop, preventing further forward motion even as the rollers continue to feed the trailing edge of the sheet. The buckle chute is narrow enough that no portion of the sheet already in the buckle chute can move in anyway to accommodate the continued forward motion of the trailing edge. As a result the sheet buckles outside the chute into the nip between two further rollers which grab onto and begin pulling the sheet where it is buckled, creating a fold. Several buckle chutes may be arranged in series to create more than one fold.

Often in paper folding machines sheets become jammed in the region of the buckle chute. Previously known solutions have required that the buckle chute either be removed from the folding machine, or that a large portion of the machine attached to a sidewall of the buckle chute be swung open for top access. In view of this, it would be desirable to have rapid and simple access to the interior of the buckle chute in order to remove jammed sheets that does not entail removing the buckle chute from the folding machine, and that allows access to jams from the side of the machine.

It would further be desirable that the folding machine buckle chute have at least one pivotable sidewall held by a movable latch, such that when the latch is locked, at least one sidewall is held firmly in place, and when it is necessary to clear a paper jam, the latch can be released, allowing at least one sidewall to be swung open.

SUMMARY OF THE INVENTION

It is an object of the invention to provide means for rapid and simple access to the interior of a folding machine buckle chute to clear jammed paper.

In accordance with the invention, there is provided a folding machine buckle chute with first and second sidewalls, spaced from and parallel to each other, in which the first sidewall pivots on a hinge between a closed position and an open position. Additionally, the invention provides a means for holding at least the first sidewall in the closed position.

BRIEF DESCRIPTION OF THE DRAWINGS

The above and other objects and advantages of the invention will be apparent upon consideration of the following detailed description, taken in conjunction with the accompanying drawings, in which like reference characters refer to like parts throughout, and in which.

DETAILED DESCRIPTION OF THE INVENTION

Folding machines are commonly used to fold sheets of paper—for example, for high-volume mail applications. Typically in these machines, single or multiple sheets are folded at least once, then conveyed to an inserter or envelope stuffer. In folders, buckle chutes perform the function of restraining the leading edge and a substantial leading portion of a sheet of paper as it is urged forward by rollers. The sheet buckles because it is both restrained by the chute and pushed forward by the rollers. The chutes are arranged so that the buckled portion is picked up by further rollers that fold the paper in the region of the buckle. Multiple folds may be formed by cascading a series of buckle chute and roller arrangements.

Depending on a combination of various factors including the caliber of the paper used and the ambient relative humidity, sheets may jam in the folding machine, including in the buckle chutes. Jammed paper is often difficult to remove from a buckle chute, and may require the time-consuming disassembly of a portion of the folding machine In accordance with the present invention, however, no disassembly is required and access to jams is simple and rapid.

In accordance with the present invention, the buckle chute sidewalls may be pivoted open, allowing an operator to remove jammed paper. Additionally, a single latch is provided that holds both sidewalls closed, but when the sidewalls are open allows the operator to first close one sidewall, and then close the second sidewall without allowing the first sidewall to slip free. Thus it is easy to quickly and accurately close the buckle chute sidewalls after clearing a paper jam.

Figure 1:
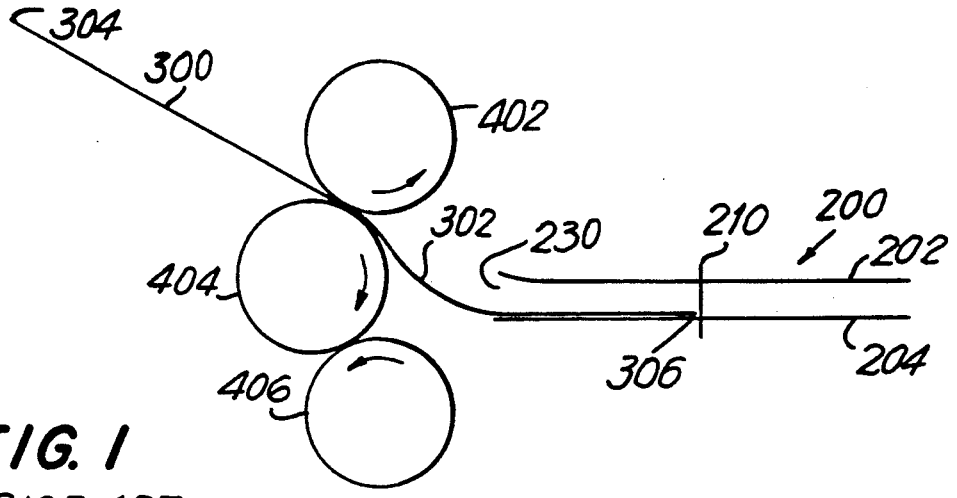
FIG. 1 PRIOR ART
FIG. 1 is a schematic diagram showing the function of the rollers, buckle chute and paper stop in a folding machine.
Figure 2:
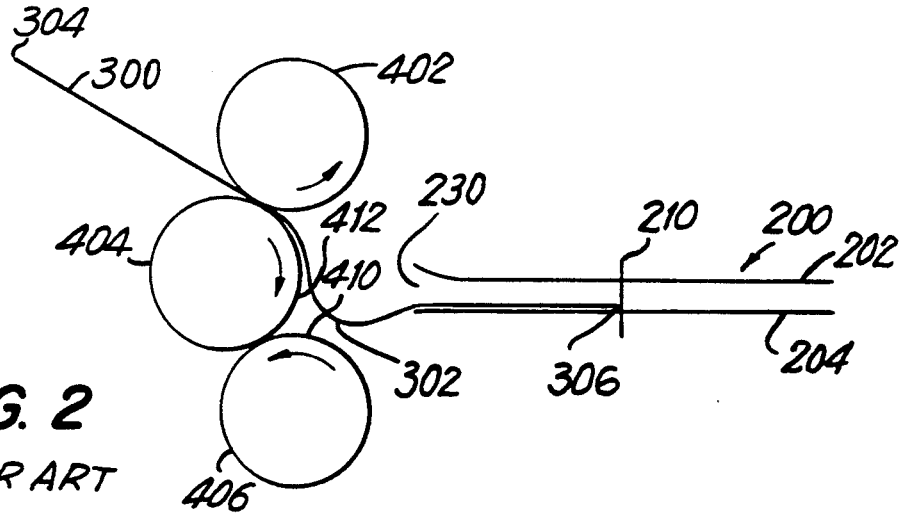
FIG. 2 PRIOR ART
FIG. 2 is a schematic diagram showing the folding machine of FIG. 1 as the paper starts to buckle.
Figure 3:
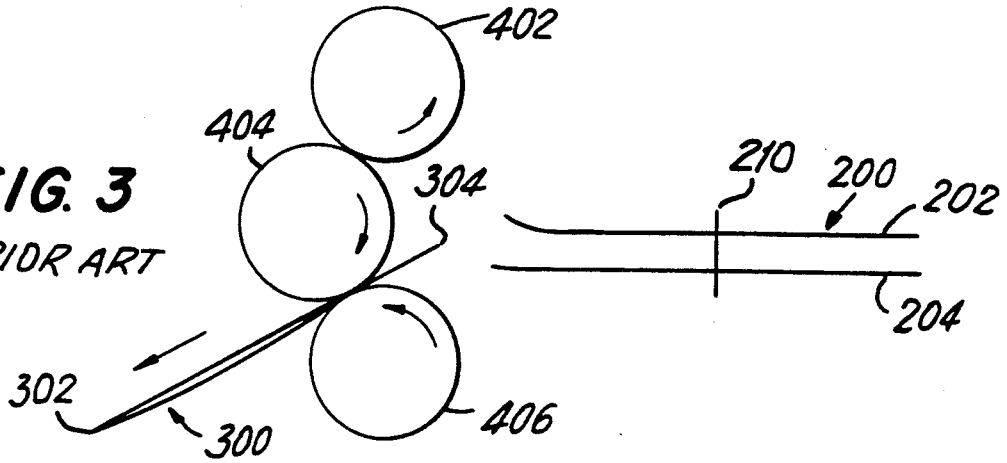
FIG. 3 PRIOR ART
FIG. 3 is a schematic diagram showing the folding machine of FIGS. 1 and 2 after the paper has been folded.

Referring to FIG. 1, in a typical folding machine paper sheet 300 is fed between counterclockwise-rotating roller 402 and clockwise-rotating roller 404, which urge leading edge 306 of sheet 300 through entrance slot 230 of buckle chute 200 until edge 306 contacts paper stop 210. Because sheet 300 is both (a) urged in a direction toward buckle chute 200 by rollers 402 and 404 and (b) held by the combination of buckle chute sidewalls 202 and 204 and paper stop 210, sheet 300 buckles at fold position 302. Shown in FIG. 2, the continuation of the buckling process forces fold position 302 closer to roller surface 412 of roller 404 and roller surface 410 of counterclockwise-rotating roller 406. As shown in FIG. 3, when sheet 300 contacts roller surfaces 410 and 412, sheet 300 is drawn between rollers 406 and 404, folding sheet 300 at fold position 302. Depending on the desired application, the folding machine may be configured such that sheet 300 is cascaded into another buckle chute for further folding, or is inserted into an envelope.

Figure 4:
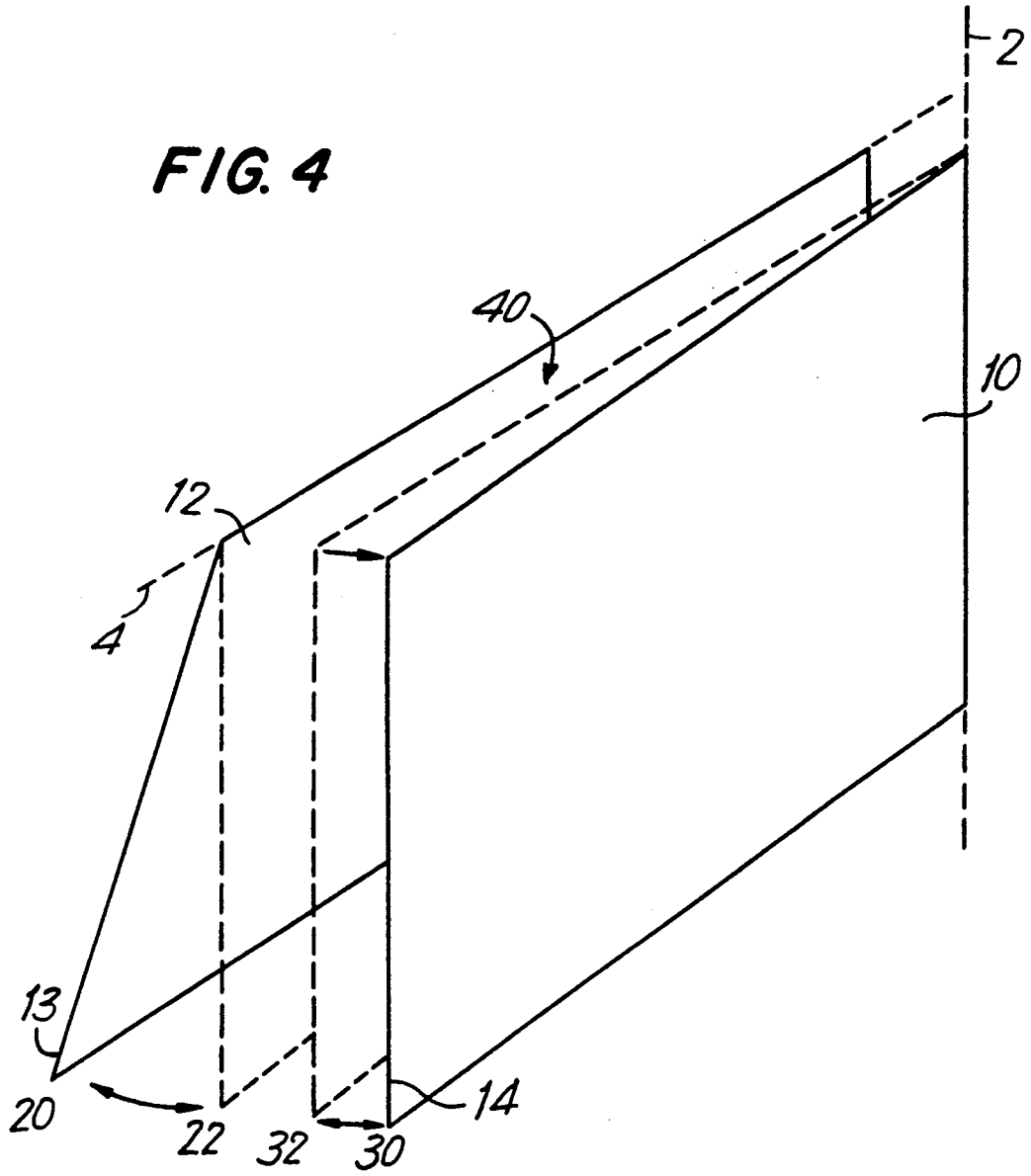
FIG. 4 is a simplified schematic diagram of the buckle chute sidewalls, in accordance with a preferred embodiment of the invention, in the open position, also swing the axes about which they pivot.
Figure 7:
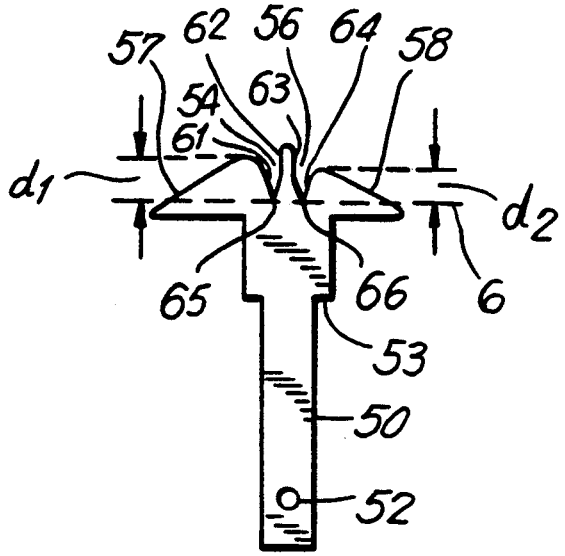
FIG. 7 is a top view of a preferred embodiment of a latch according to the invention.

Referring to FIG. 4, the buckle chute of the present invention has sidewalls 10 and 12. Sheets are urged through slot 40 by rollers until contacting paper stops within slot 40 that work with sidewalls 10 and 12 to hold the sheets as the rollers continue to urge the paper forward, causing it to buckle. If a jam occurs, sidewall 10 may be pivoted about vertical axis 2 from closed position 32 to open position 30 as shown. Similarly, sidewall 12 may be pivoted about horizontal axis 4 from closed position 22 to open position 20, shown.

Figure 5:
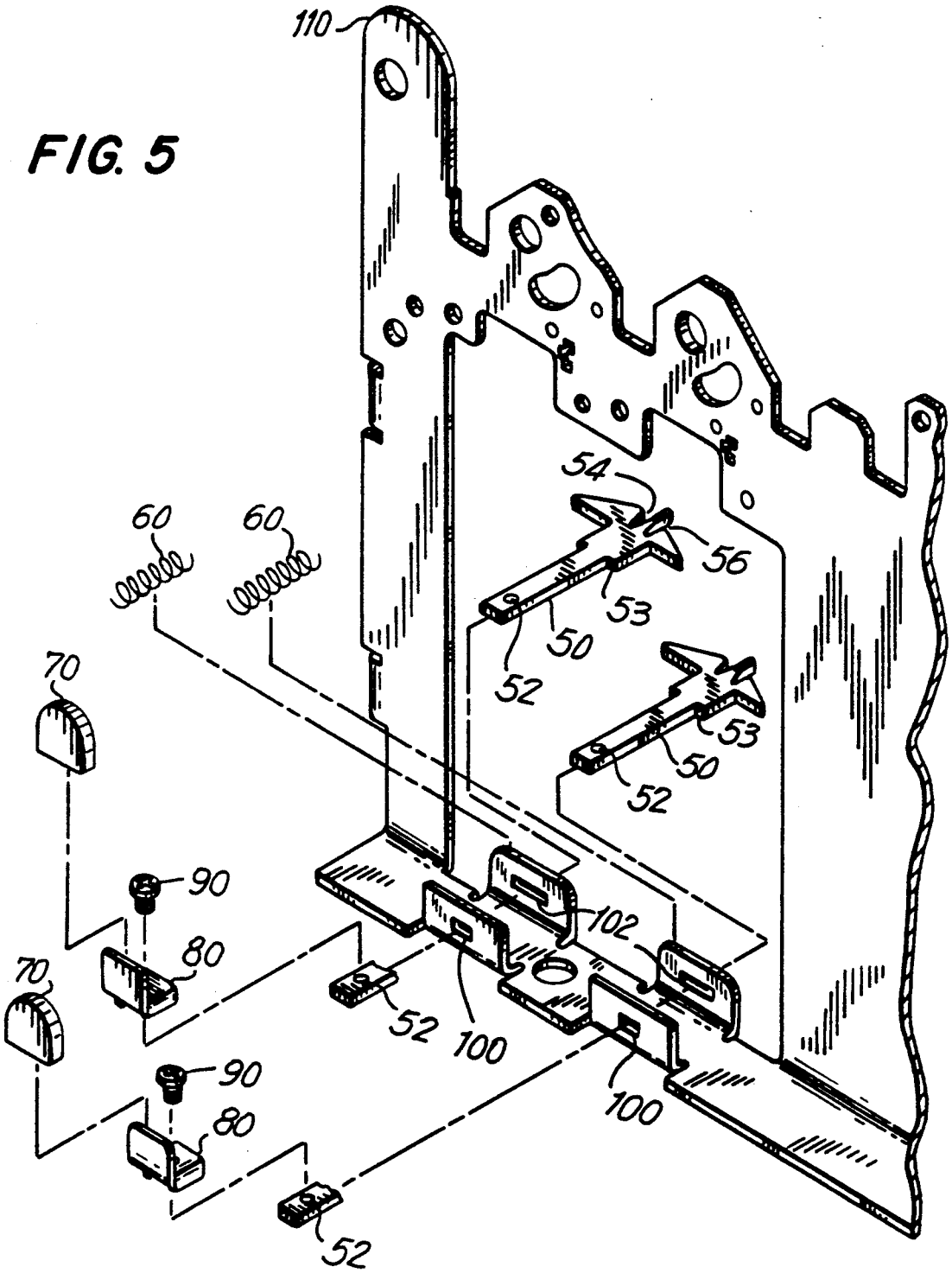
FIG. 5 is an exploded perspective view of a preferred embodiment of the buckle chute jam access latch mechanism.
Figure 6:
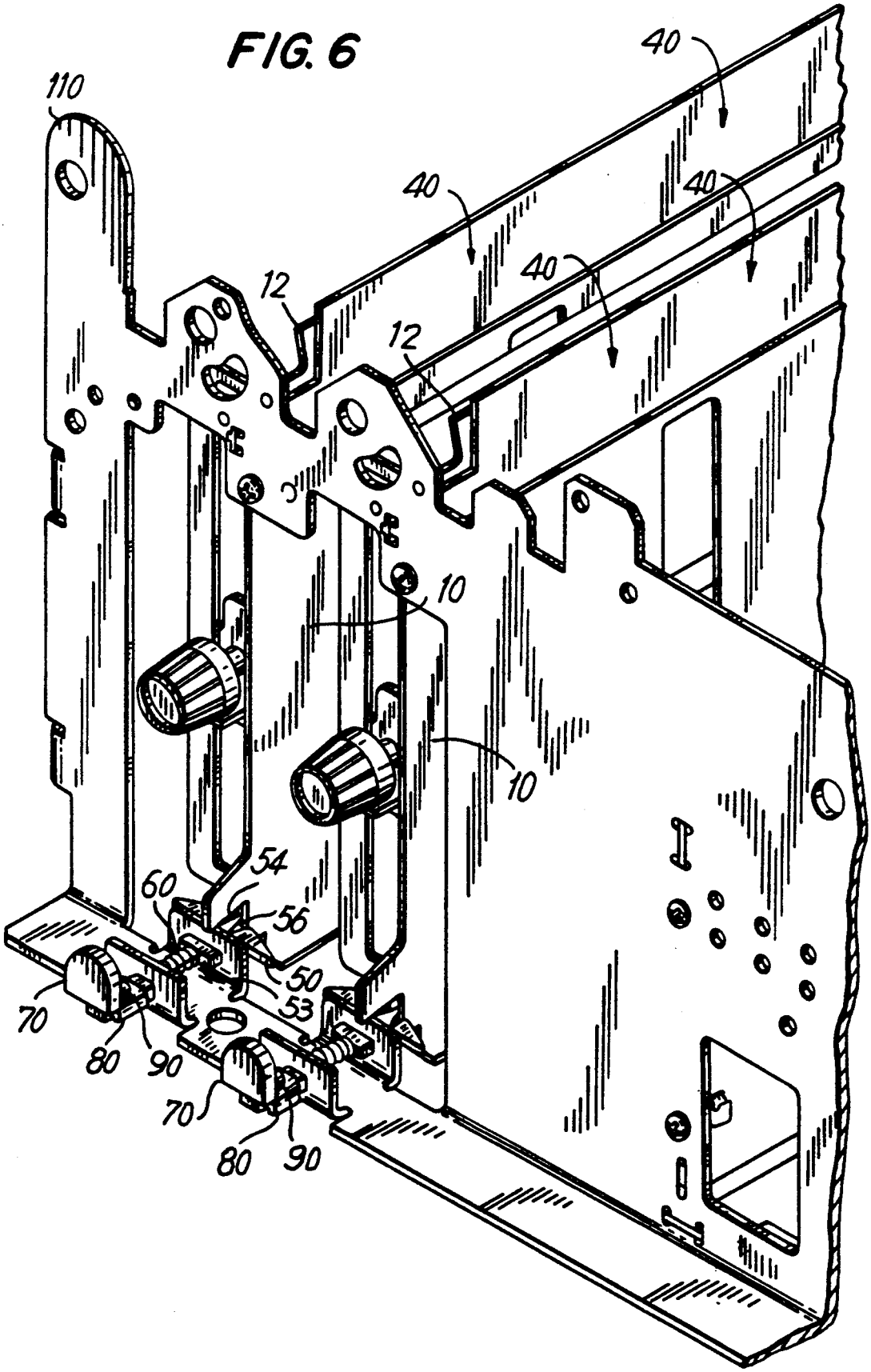
FIG. 6 is a perspective view of a preferred embodiment of the present invention having two buckle chutes with jam access.

Referring to FIGS. 5 and 6 which show a particularly preferred embodiment of the present invention, sidewalls 10 and 12 are held closed by latch 50. As seen in the exploded view of FIG. 5, latch 50 has slots 56 and 54 that receive edges of sidewalls 10 and 12, for holding sidewalls 10 and 12 in closed positions 32 and 22 respectively. The folding machine of the present invention has front side frame 110 which supports, in this illustrative embodiment, two buckle chutes, and therefore two latches 50. Side frame 110 has slots 100 and 102 for receiving latch 50 for reciprocating motion within. Spring 60 is fit over latch 50 between slots 100 and 102. Latch 50 is finished with sheet metal latch handle 80, attached to latch 50 at tapped hole 52 by screw 90. Vinyl cap 70 may be provided on latch handle 80 to cover rough edges or burrs, as well as for aesthetic reasons.

Referring to FIG. 6, spring 60 presses against lower surface 53 of latch 50, urging latch 50 towards sidewalls 10 and 12. Sidewalls 10 and 12 are held by slots 56 and 54 in closed positions 32 and 22 respectively. The user, by pulling on handle 70 in a direction away from sidewalls 10 and 12, moves latch 50 and allows sidewalls 10 and 12 to clear slots 56 and 54. Access to jammed sheets of paper may be accomplished by swinging sidewall 10, sidewall 12, or both, into their respective open positions 30 and 20.

The present invention also provides means for simply and rapidly returning sidewalls 10 and 12 to closed positions 32 and 22, respectively, to resume operation of the paper folding machine. Referring to FIGS. 4–7, to close sidewalls 10 and 12 an operator first pivots sidewall 12 toward position 22. The displacement of sidewall 12 is fixed along axis 4, so that when edge 13 of sidewall 12 contacts cam-follower surface 57 of latch 50, there is a camming action that translates the pivoting motion of sidewall 12 into motion of latch 50 in a direction away from sidewall 12, compressing spring 60. The slope of cam-follower surface 57 is fairly shallow (close to being parallel to the plane of side frame 110). This shallow slope provides a mechanical advantage that allows the force of lower edge 13 of sidewall 12 against latch 50 to overcome that of spring 60. As latch 50 is further urged in the direction away from sidewall 12, sidewall 12 clears cam-follower surface 57 and, as spring 60 urges latch 50 in a direction toward sidewall 12, sidewall 12 becomes engaged and held in slot 54 between surfaces 61 and 62. The slopes of surfaces 61 and 62 are steep with respect to the slope of cam-follower surface 57, and hold sidewall 12 firmly in place with lower edge 13 aligned with line 6 shown in FIG. 7.

To completely close the buckle chute, sidewall 10 is then pivoted by the operator toward closed position 32. As in the case of sidewall 12, edge 14 of sidewall 10 contacts shallowly sloped camfollower surface 58 of latch 50, providing a camming action that urges latch 50 in a direction away from sidewall 10, compressing spring 60. As latch 50 is further urged in the direction away from sidewall 10, sidewall 10 clears cam-follower surface 50. At the point of this clearance, edge 14, which when sidewall 10 is in closed position 32 is aligned with line 6 shown in FIG. 7, has urged latch 50 a distance $d_2$ from its resting position. Since this displacement is less than the depth $d_1$ of slot 54, edge 13 of sidewall 12 remains trapped by surfaces 61 and 62 of latch 50. Spring 60 now urges latch 50 in a direction toward sidewall 14, engaging and holding sidewall 10 in closed position 32 between steeply sloped surfaces 63 and 64. Edge 13 of sidewall 12 was not released by closing sidewall 10, so that both sidewalls 10 and 12 are now closed and latched. By closing sidewalls 10 and 12 in the proper order (first sidewall 12, then sidewall 10), the buckle chute may be closed without the need to align both of sidewalls 10 and 12 with their respective closed positions 32 and 22 at the same time, as would be required if the depths of slots 54 and 56 were equal. Further, the provision of two slots 100, 102 to guide each latch 50, and the narrow dimension at the bottom of slots 54 and 56, assure that when sidewalls 10 and 12 are closed, they are securely and properly positioned with the correct spacing for correct operation of the buckle chute.

Thus it is seen that rapid and simple side access means are provided for accessing paper jams in folding machine buckle chutes, which provides means for side access to a folding machine buckle chute, avoiding the need for removal of the chute from the machine to clear jams, and which provides folding machine buckle chute jam access means comprising at least one pivotable buckle chute sidewall secured by a movable latch. One skilled in the art will appreciate that the present invention can be practiced by other than the described embodiments, which are presented for purposes of illustration and not of limitation, and the present invention is limited only by the claims which follow.

What is claimed is:

1. A folding machine buckle chute apparatus comprising:

a first sidewall;

a second sidewall spaced from and substantially parallel to said first sidewall;

first hinge means for allowing said first sidewall to pivot between a first closed position and a first open position; and holding means for holding said first sidewall in said first closed position, wherein said holding means comprises a reciprocating latch element having a first slot therein for engaging and holding said first sidewall in said first closed position, said latch being reciprocable between: (a) a first latch position in which said first slot engages and holds said first sidewall, and (b) a second latch position in which said slot clears said first sidewall and said first sidewall may be pivoted to said first open position.

2. The apparatus of claim 1 further comprising second hinge means for allowing said second sidewall to pivot between a second closed position and a second open position, wherein:

said holding means holds said second sidewall in said second closed position.

3. The apparatus of claim 2 wherein said latch has a second slot therein for (a) engaging and holding said second sidewall in said second closed position when said latch is in said first latch position, and (b) allowing said second sidewall to be swung to said second open position when said latch is in said second latch position.

4. The apparatus of claim 3 wherein:

said first slot has a first depth; and said second slot has a second depth less than said first depth whereby:

said latch is reciprocable to a third position, intermediate said first position and said second position, in which third position said first slot engages and holds said first sidewall and said second slot is out of engagement with said second sidewall.

5. The apparatus of claim 4 wherein:

said first depth is defined by a first cam-follower surface; and said second depth is defined by a second cam-follower surface wherein:

each of said first and second camfollower surfaces has a slope for translating motion of each of said sidewalls toward said respective first and second closed positions into reciprocating motion of said latch element.

6. The apparatus of claim 3 further comprising biasing means urging said latch element into engagement with said first and second sidewalls;

said latch further has cam-follower surfaces for translating motion of said sidewalls toward said respective first and second closed positions into motion of said latch element against said biasing means.

7. The apparatus of claim 1 further comprising biasing means urging said latch element into engagement with said first sidewall; wherein:

said latch further has a cam-follower surface for translating motion of said first sidewall toward said first closed position into motion of said latch element against said biasing means.

8. The apparatus of claim 1 further comprising a second hinge for allowing said second sidewall to pivot between a second closed position and a second open position, wherein said holding means holds said second sidewall in said second closed position.

9. The apparatus of claim 8 wherein said holding means comprises a reciprocating latch element having a first slot therein for engaging and holding said first sidewall in said first closed position and a second slot therein for engaging and holding said second sidewall in said second closed position; wherein:

when said latch is in a first latch position, said first and second slots engage and hold said first and second sidewalls in said respective first and second closed positions;

when said latch is in a second latch position said latch is out of engagement with said first and second sidewalls; and when said latch is in a third latch position intermediate said first latch position and said second latch position, said first slot engages and holds said first sidewall and said latch is out of engagement with said second sidewall.

10. A folding machine buckle chute apparatus comprising:

a first sidewall;

a second sidewall spaced from and parallel to said first sidewall;

first hinge means for allowing said first sidewall to pivot between a first closed position and a first open position;

second hinge means for allowing said second sidewall to pivot between a second closed position and a second open position; and holding means for engaging and holding said first sidewall in said first closed position and said second sidewall in said second closed position;

wherein said holding means comprises a reciprocating latch element having a first slot therein for engaging and holding said first sidewall in said first closed position and a second slot therein for engaging and holding said second sidewall in said second closed position; wherein:

when said latch is in a first latch position, said first and second slots engage and hold said first and second sidewalls in said respective first and second closed positions;

when said latch is in a second latch position, said first and second slots are out of engagement with said first and second sidewalls; and when said latch is in a third latch position, intermediate said first position and said second position, in which third position said first slot engages and holds said first sidewall and said second slot is out of engagement with said second sidewall.

11. The apparatus of claim 10 further comprising:

biasing means urging said latch element into engagement with said first and second sidewalls; and wherein:

said latch further has cam-follower surfaces for translating motion of said sidewalls toward said respective first and second closed positions into motion of said latch element against said biasing means.

* * * * *